US011761345B2

(12) United States Patent
Dos Santos et al.

(10) Patent No.: US 11,761,345 B2
(45) Date of Patent: Sep. 19, 2023

(54) TURBINE OVERSPEED DISENGAGEMENT DEVICE FOR A TURBINE ENGINE

(71) Applicant: SAFRAN AIRCRAFT ENGINES, Paris (FR)

(72) Inventors: Antoine Hervé Dos Santos, Moissy-Cramayel (FR); Joao Antonio Amorim, Moissy-Cramayel (FR); Pascal Grégory Casaliggi, Moissy-Cramayel (FR); Nicolas Xavier Trappier, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/791,829

(22) PCT Filed: Jan. 8, 2021

(86) PCT No.: PCT/FR2021/050021
§ 371 (c)(1),
(2) Date: Jul. 8, 2022

(87) PCT Pub. No.: WO2021/140301
PCT Pub. Date: Jul. 15, 2021

(65) Prior Publication Data

US 2023/0033362 A1 Feb. 2, 2023

(30) Foreign Application Priority Data

Jan. 10, 2020 (FR) ..... 2000227

(51) Int. Cl.
*F01D 21/04* (2006.01)
*F01D 5/02* (2006.01)

(52) U.S. Cl.
CPC ..... *F01D 21/045* (2013.01); *F01D 5/025* (2013.01); *F01D 5/026* (2013.01);
(Continued)

(58) Field of Classification Search
CPC ..... F01D 21/045; F01D 5/025; F01D 5/026; F05D 2270/021; F05D 2270/09; F05D 2260/31; F05D 2260/32; F05D 2260/36
See application file for complete search history.

(56) References Cited

U.S. PATENT DOCUMENTS 3,077,334 A * 2/1963 Rubio ..... F16D 1/0894 403/377
4,201,513 A * 5/1980 Sales ..... F01D 21/045 416/135
(Continued)

FOREIGN PATENT DOCUMENTS

EP 0 359 659 A1 3/1990
EP 1 505 264 A1 2/2005
(Continued)

OTHER PUBLICATIONS

English machine translation of EP1505264A1, Jan. 25, 2023.*
(Continued)

*Primary Examiner* — Christopher Verdier
(74) *Attorney, Agent, or Firm* — CHRISTENSEN O'CONNOR JOHNSON KINDNESS PLLC

(57) ABSTRACT

An assembly for a turbine engine turbine includes a turbine rotor disc centered on a longitudinal axis and a turbine shaft centered on the longitudinal axis and driven in rotation by the rotor disc. Torque from the rotor disc is transmitted to the shaft, wherein the rotor disc is locked in translation relative to the shaft in the direction of the longitudinal axis by a screwed member on the shaft. Torque from the rotor disc is transmitted from the rotor disc to the screwed member when the torque ceases being transmitted from the rotor disc to the shaft. The screwed member has an unscrewing direction identical to the direction of rotation of the rotor disc in operation.

12 Claims, 4 Drawing Sheets

(52) U.S. Cl.
CPC ..... *F05D 2260/31* (2013.01); *F05D 2260/36* (2013.01); *F05D 2270/021* (2013.01); *F05D 2270/09* (2013.01)

(56) References Cited

U.S. PATENT DOCUMENTS

| | | | | |
|---|---|---|---|---|
| 4,375,906 | A * | 3/1983 | Roberts | F01D 5/025 384/126 |
| 5,492,447 | A | 2/1996 | Mannava et al. | |
| 2018/0016929 | A1 * | 1/2018 | Accary | F01D 25/00 |

FOREIGN PATENT DOCUMENTS

| | | | | |
|---|---|---|---|---|
| EP | 1640564 | A1 * | 3/2006 | F01D 21/045 |
| GB | 2 377 731 | A | 1/2003 | |

OTHER PUBLICATIONS

International Search Report dated May 19, 2021, issued in corresponding International Application No. PCT/FR2021/050021, filed Jan. 8, 2021, 5 pages.
Written Opinion dated May 19, 2021, issued in corresponding International Application No. PCT/FR2021/050021, filed Jan. 8, 2021, 5 pages.
English translation of Written Opinion dated May 19, 2021, issued in corresponding International Application No. PCT/FR2021/050021, filed Jan. 8, 2021, 6 pages.
International Preliminary Report on Patentability dated Jul. 12, 2022, issued in corresponding International Application No. PCT/FR2021/050021, filed Jan. 8, 2021, 6 pages.

* cited by examiner

TURBINE OVERSPEED DISENGAGEMENT DEVICE FOR A TURBINE ENGINE

FIELD OF THE DISCLOSURE

The disclosure concerns an assembly for a turbine engine turbine.

More specifically, the disclosure relates to an assembly for a turbine engine turbine comprising a means for disengaging the turbine in the event of overspeed.

In a turbine engine, a fan is driven in rotation by a turbine having a rotor disc equipped with moving vanes and connected to a low pressure compressor. If a shaft connecting the fan to the turbine breaks, the resistive torque on the turbine is abruptly cancelled while the engine gas flow continues to transmit energy to the rotor disc. This causes an uncontrolled increase in the speed of the rotor disc(s) and thus a risk of bursting, resulting in the release of high energy flows. In this case, the turbine is in "overspeed".

EP1640564 proposes a device that uses the downstream displacement of the turbine to limit the overspeed of the turbine. The device comprises means of destruction of the moving vanes arranged in downstream stator vanes of the turbine. However, downstream displacement of the rotor disc can be prevented by means of translational fixing of the turbine with respect to its axis of rotation. As a result, the moving vanes are not damaged by the means of destruction. Such devices therefore lack effectiveness and reliability in limiting overspeed.

SUMMARY

One of the purposes of the disclosure is to ensure downstream movement of the turbine in the event of shaft failure so that an annular row of moving vanes comes into contact with an annular row of stator vanes, thereby allowing destruction of the annular row of moving vanes by the annular row of stator vanes, thus slowing down the turbine.

Another purpose of the disclosure is to limit the overspeed of the turbine in a reliable and efficient manner in the event of a shaft failure.

To this end, the disclosure proposes an assembly for a turbine engine turbine having a longitudinal axis comprising:

- a turbine rotor disc centered on the longitudinal axis,
- a turbine shaft centered on the longitudinal axis and driven in rotation by the rotor disc,
- first means of transmitting torque from the rotor disc to the shaft, wherein the rotor disc is locked in translation relative to the shaft in the direction of the longitudinal axis by a screwed member on the shaft and
- second means of transmitting torque from the rotor disc to the screwed member, wherein the screwed member has an unscrewing direction identical to the direction of rotation of the rotor disc in operation and the second means of transmitting torque are configured to transmit the rotational torque from the rotor disc to the screwed member when the first means of transmitting torque cease to transmit torque from the rotor disc to the shaft.

The disclosure is advantageous in that the screwed member has an unscrewing direction identical to the direction of rotation so that the second means of transmission cause the screwed member to unscrew when the first means of transmitting torque cease to transmit torque from the rotor disc to the shaft. As a result, the turbine is no longer restrained in the axial direction and can move backwards, thereby causing the destruction of its moving vanes against a stator of the turbine engine. This prevents the turbine from overspeeding, as the destroyed moving vanes no longer provide energy. The disclosure therefore provides reliable and effective overspeed limitation of the turbine in the event of loss of power transmission from the shaft to the rotor disc.

In one embodiment, the first means of transmitting torque may comprise first longitudinal splines formed on the shaft and distributed circumferentially around the longitudinal axis and second longitudinal splines engaging with the first splines and formed in an inner annular side of the rotor disc.

The first means of transmitting torque can cease to transmit torque from the rotor disc to the shaft if the first and/or second splines break or are damaged.

The second means of transmitting torque may comprise a ring centered on the longitudinal axis and comprising first pins cooperating with recesses formed in the screwed member and second pins cooperating with recesses formed in the rotor disc.

The first pins allow the screwed member to be rotated when the ring is rotated by the rotor disc through the second pins, for example when the first means of transmitting torque cease to transmit torque from the rotor disc to the shaft.

In one embodiment, the circumferential clearance between the first splines and the second splines may be less than the sum of the circumferential clearance between the second pins and the rotor disc and the circumferential clearance between the first pins and the screwed member.

Thus, the transmission of rotation from the rotor disc to the shaft is favoured and the screwed member is not rotated when the first means of transmitting are able to transmit rotation from the rotor disc to the shaft.

In one embodiment, the ring may comprise an annular section, with the first pins extending upstream and the second pins being arranged downstream from the first pins.

In addition, at least one of the first pins and of the second pins may comprise concave rounded portions for connection to the annular section. This allows for a better mechanical strength of the ring.

The second pins may extend mainly in the direction of the longitudinal axis. The second pins can extend downstream in the direction of the longitudinal axis.

The second pins may extend mainly in a radial direction perpendicular to the longitudinal axis.

The number of second pins may be greater than the number of recesses in the rotor disc.

The number of first pins may be greater than the number of recesses in the screwed member.

A number of pins greater than the number of recesses facilitates tight fitting of the ring to the rotor disc on the one hand and to the screwed member on the other hand.

The number of second pins may be less than the number of first pins.

The ring can be mounted in different ways. For example, the ring can be mounted around the screwed member. The ring can be locked in translation in the downstream direction by a circlip installed in a groove in the screwed member.

In one embodiment, an annular space may be provided immediately downstream from the screwed member. The annular space may have a longitudinal dimension greater than or equal to a longitudinal distance between moving vanes connected to the rotor disc and stator vanes immediately downstream from the turbine.

Thus, the turbine can be moved back far enough for the stator vanes to come into contact with vanes connected to the rotor disc.

The shaft can be connected to a low-pressure compressor of the turbine engine.

According to another aspect, the disclosure proposes a turbine, such as a low-pressure turbine, comprising the above-mentioned assembly.

In one embodiment, the turbine may extend around a longitudinal axis, and comprise a stator and a rotor rotatably mounted in the stator. The rotor may comprise an assembly as aforesaid, wherein the ring is lockable in translation downstream by a circlip installed in a groove in the screwed member.

An annular space may be arranged immediately downstream from the screwed member, wherein the annular space has a longitudinal dimension greater than or equal to a longitudinal distance between moving vanes connected to the rotor disc and stator vanes located immediately downstream from the moving vanes.

According to another aspect, the disclosure proposes a turbine engine, such as an aircraft turbojet engine, equipped with the above-mentioned assembly.

DETAILED DESCRIPTION

Figure 1:
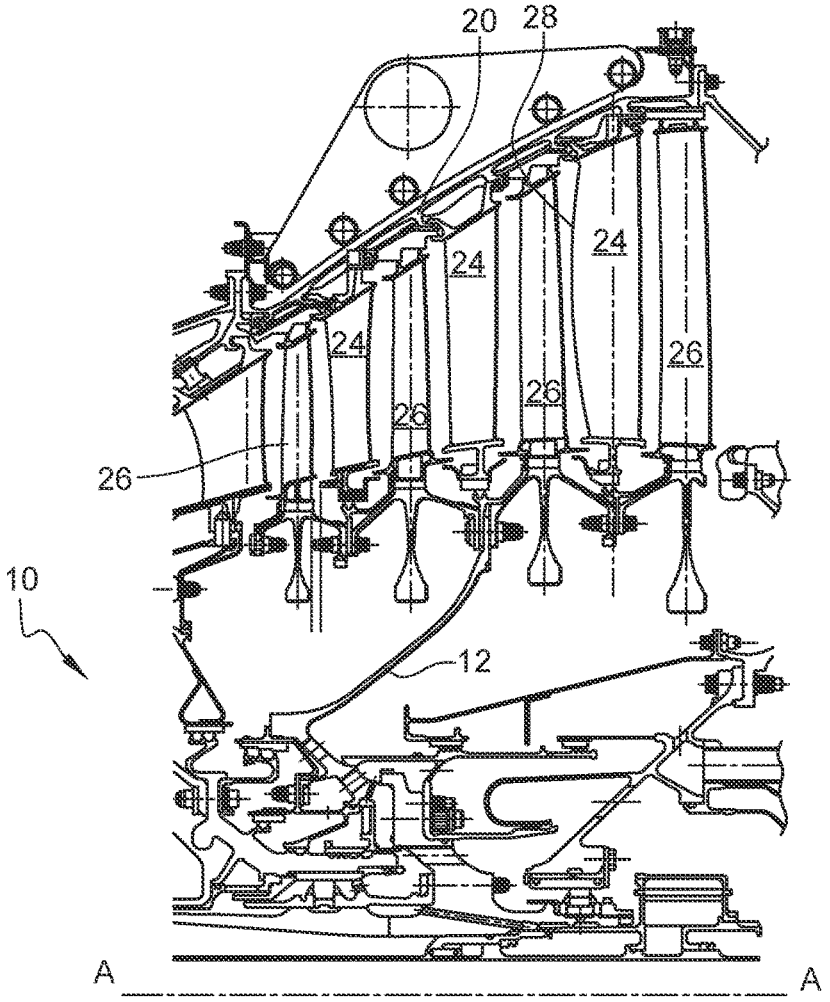
FIG. 1 shows a partial sectional view of a turbine of a turbine engine.
Figure 2:
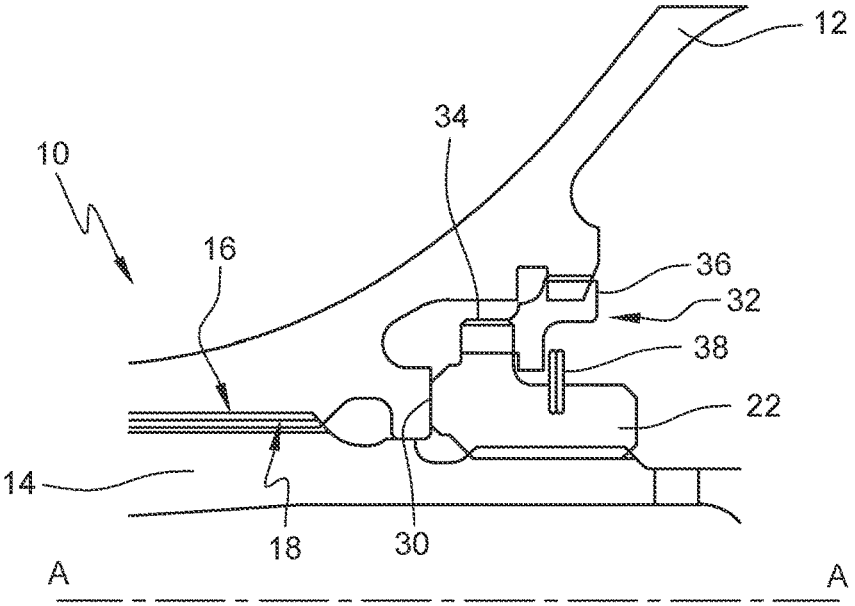
FIG. 2 shows a partial sectional view of a first example of the assembly according to the disclosure.
Figure 3:
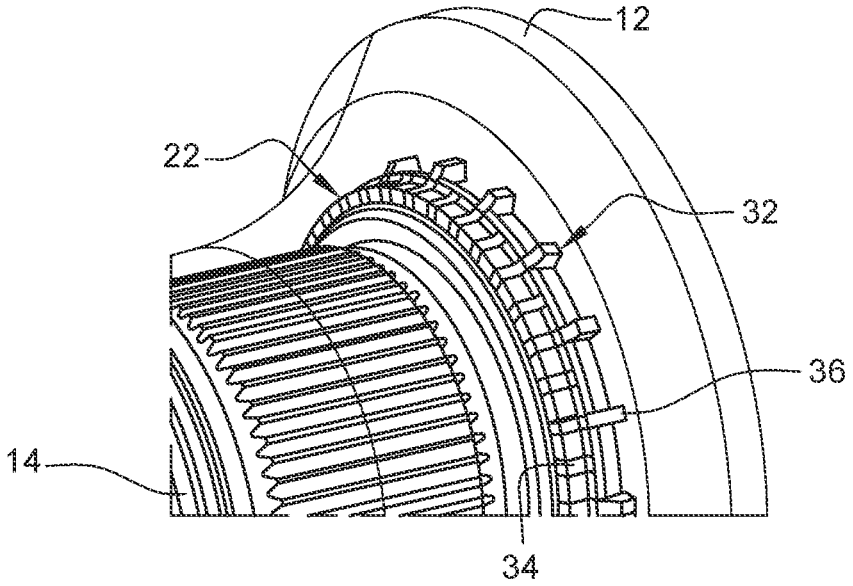
FIG. 3 shows a perspective view of the first example of the assembly according to the disclosure.

With reference to FIGS. 1 to 3, the turbine 10 comprises a plurality of stator vanes 24 connected to a fixed casing 20 and a plurality of moving vanes 26 connected to a rotor disc 12 rotatable around a longitudinal axis of rotation A-A. Each of the stator vanes 24 is provided with a convex protrusion 28 which faces upstream from an internal platform and which is shaped to shear the moving vanes 26 when they contact the protrusions. In particular, the protrusion 28 is curved with a convex surface of the vane 24 facing upstream.

The rotor disc 12 is arranged to rotate a shaft 14 of the turbine 10. For example, the shaft 14 may be connected to a low-pressure compressor of a turbine engine equipped with the turbine 10. The rotor disc 12 comprises an annular section arranged around the shaft 14 and comprises on an inner side, i.e., oriented radially inwards, splines 16 distributed circumferentially around the axis of rotation A-A. The splines 16 extend over a longitudinal part of the inner side of the rotor disc 12. The shaft 14 comprises on its outer side splines 18, distributed circumferentially around the axis of rotation A-A, and engaging with the splines 16 of the rotor disc 12 for transmitting the torque from the latter to the shaft 14. The splines 18 extend over a longitudinal part of the shaft 14.

The rotor disc 12 is held in translation in the direction of the axis of rotation A-A by a nut 22 screwed onto the shaft 14 and abutting against a flange 30 of the rotor disc 12. The nut 22 is mounted on the shaft 14 in such a way that its unscrewing direction is identical to the direction of rotation of the turbine 10. For this purpose, a thread is provided in the shaft 14 to ensure such an unscrewing direction.

If the shaft 14 or the connection between the shaft 14 and the rotor disc 14 fails, there is a risk that the turbine 10 will overspeed uncontrollably as a result of the hot gases from an upstream combustor driving the vanes in rotation. In order to limit overspeed, the convex protrusions 28 of the stator vanes 24 are arranged to shear and feather the moving vanes 26 to reduce or even cancel the energy received by the turbine 10. These protrusions are formed at the leading edge of the vanes. More particularly, the leading edge of each vane thus comprises a convex surface.

In order to ensure that the protrusions 28 contact the moving vanes 24, the turbine includes a ring 32 configured to unscrew the nut 22 in the event of damage to the shaft 14, thereby releasing the rotor disc 12 in translation in the direction of the axis of rotation A-A.

The ring 32 is annular and arranged between the nut 22 and the rotor disc 12. The ring 32 comprises first pins 34, distributed circumferentially around the axis of rotation A-A, engaging with recesses provided in the shaft 14. The ring 32 also comprises second pins 36, distributed circumferentially around the axis of rotation A-A, engaging with recesses provided in the rotor disc 12.

When the shaft 14 fails or the splines 16 and 18 are disengaged from each other, the ring 32 transmits the rotation of the rotor disc 12 to the nut 22. Thus, the nut 22 is unscrewed by the rotation of the turbine 10, which releases the turbine 10 in translation. The turbine 10 moves downstream along the axis of rotation A-A, causing the moving vanes 26 to be sheared off by the protrusions 28 of the stator vanes 24 downstream from the moving vanes 26.

The turbine 10 comprises a space downstream from the nut 22 having a length greater than the distance between the protrusions 28 of the stator vanes 24 and the moving vanes 26. For example, the length of the space may be greater than or equal to twice the distance.

The circumferential clearance between the splines 16 of the rotor disc 12 and the splines 18 of the shaft 14 may be less than the sum of the circumferential clearance between the second pins 36 and the rotor disc 12 and the circumferential clearance between the first pins 34 and the nut 22.

In addition, an annular circlip 38 is arranged downstream from the ring 32 in a location provided in the nut 22 and projecting in the radial direction away from the nut 22. The circlip 38 keeps the ring 32 fixed in translation in the direction of the axis of rotation A-A.

Figure 4:
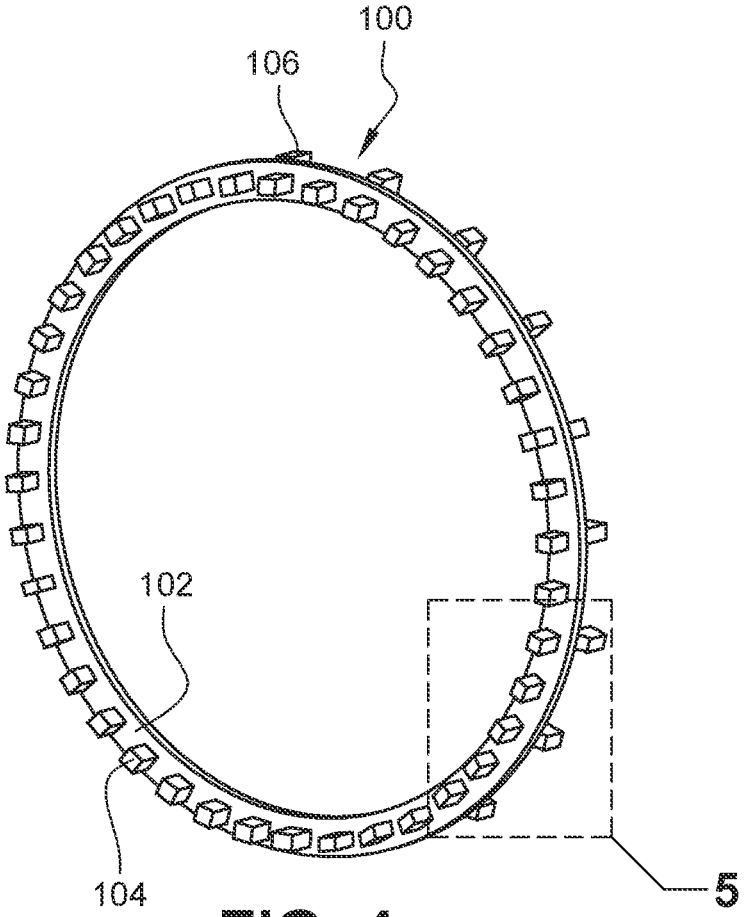
FIG. 4 shows a first embodiment of a ring according to the disclosure.
Figure 5:
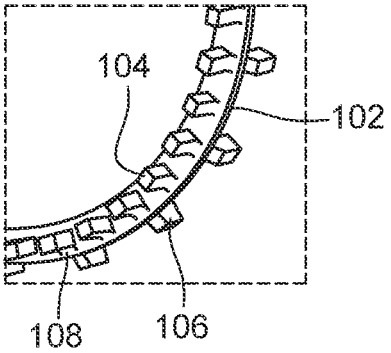
FIG. 5 shows an enlarged portion of the ring of FIG. 4.
Figure 8:
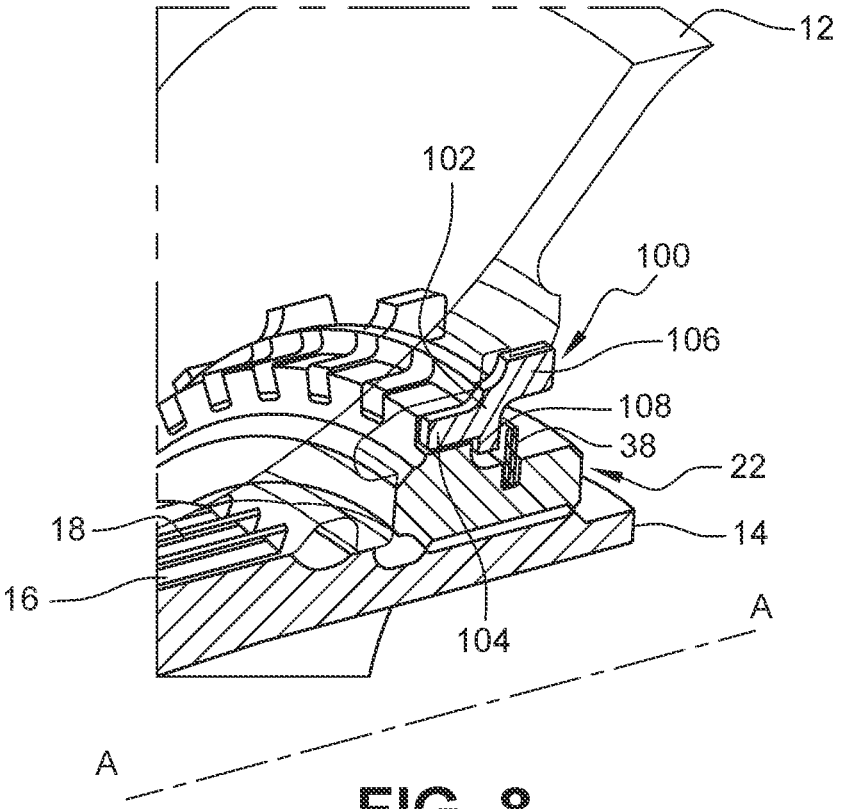
FIG. 8 shows an embodiment of an assembly according to the disclosure equipped with the ring of FIG. 4.

FIGS. 4, 5, and 8 show a first example of an embodiment of a ring 100 that can be installed in the turbine 10 in FIGS. 1-3. The ring 100 comprises an annular section 102, for example having a radius greater than the outer radius of the nut 22. The ring 100 comprises on the one hand first pins 104 and on the other hand second pins 106. The first pins 104 extend upstream in the direction of the axis of rotation A-A from the annular section 102 and engage with recesses provided in the nut 22. Similarly, the second pins 106 extend downstream from the annular section 102 in the direction of the axis of rotation A-A and engage with recesses provided in the rotor disc 12.

The number of first pins 104 is less than the number of recesses in the nut 22 and the number of second pins 106 is less than the number of recesses in the rotor disc 12. This makes it easier to fit the ring 100 into the rotor disc 12 on the one hand and into the nut 22 on the other. For example, the number of recesses in the nut 22 may be equal to or greater than twice the number of first pins 104. The number of recesses in the rotor disc 12 may be twice the number of second pins 106. In addition, the number of first pins 104 may be less than the number of second pins 106.

Each of the first pins 104 has a rounded connection with the annular section 102. Similarly, each of the second pins 106 has a rounded connection with the annular section 102. This improves the mechanical strength of the ring 32.

The ring 100 furthermore has an annular shoulder 108 borne by the annular section 102 and bounded by the first pins 104, which shoulder 108 abuts upstream on an annular shoulder of the nut 22.

The ring 100 may be made of a material identical to the material of the nut 22 and/or the rotor disc 12.

Figure 6:
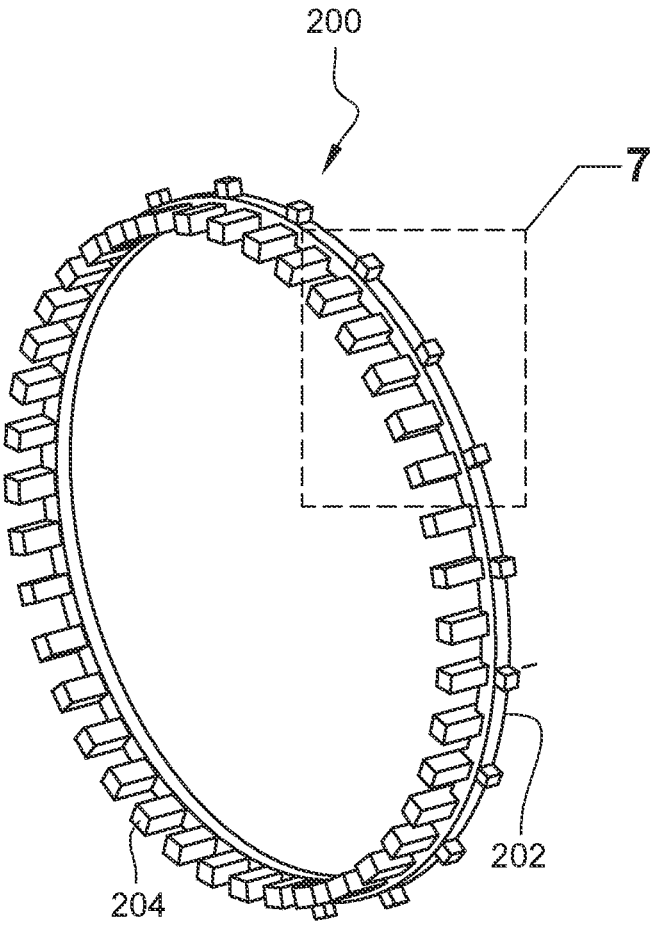
FIG. 6 shows a second embodiment of a ring according to the disclosure.
Figure 7:
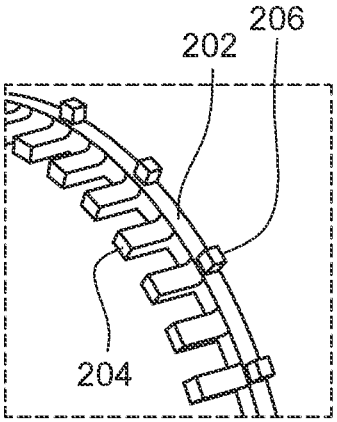
FIG. 7 shows an enlarged portion of the ring of FIG. 6.
Figure 9:
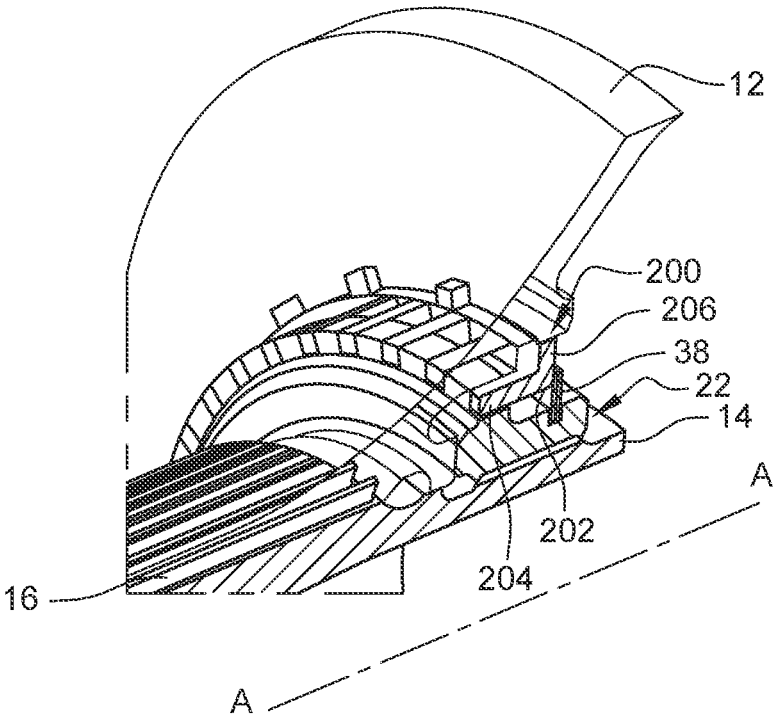
FIG. 9 shows an embodiment of an assembly according to the disclosure equipped with the ring of FIG. 6.

FIGS. 6, 7, and 9 show a second example of an embodiment of a ring 200 that can be installed in the turbine 10 in FIGS. 1-3. The ring 200 comprises an annular section 202, for example having a radius greater than the outer radius of the nut 22. The ring 200 comprises on the one hand first pins 204 and on the other hand second pins 206. The first pins 204 extend in the direction of the axis of rotation A-A and engage with recesses provided in the nut 22. Similarly, the second pins 206 extend in the direction of the axis of rotation A-A and engage with recesses provided in the rotor disc 12.

The number of first pins 204 is less than the number of recesses in the nut 22 and the number of second pins 206 is less than the number of recesses in the rotor disc 12. This makes it easier to fit the ring 200 into the rotor disc 12 on the one hand and into the nut 22 on the other. For example, the number of recesses in the nut 22 may be equal to or greater than twice the number of first pins 204. The number of recesses in the rotor disc 12 may be twice the number of second pins 206. In addition, the number of first pins 204 may be less than the number of second pins 206.

Each of the first pins 204 has a rounded connection with the annular section 102. Similarly, each of the second pins 106 has a rounded connection with the annular section 202. This improves the mechanical strength of the ring 32.

The invention claimed is:

1. An assembly for a turbine engine turbine having a longitudinal axis comprising:

a turbine rotor disc centered on the longitudinal axis, a turbine shaft centered on the longitudinal axis and driven in rotation by the rotor disc, first means for transmitting torque from the rotor disc to the shaft, wherein the rotor disc is locked in translation with respect to the shaft in a direction of the longitudinal axis by a screwed member screwed onto said shaft and second means of transmitting torque from the rotor disc to the screwed member, wherein the screwed member has an unscrewing direction identical to a direction of rotation of the rotor disc in operation and the second means of transmitting torque are configured to transmit torque from the rotor disc to the screwed member when the first means of transmitting torque cease to transmit torque from the rotor disc to the shaft.

2. The assembly according to claim 1, wherein the first means of transmitting torque comprise first longitudinal splines formed on the shaft and distributed circumferentially around the longitudinal axis and second longitudinal splines engaging with the first splines and formed in an inner annular side of the rotor disc.

3. The assembly according to claim 1, wherein the second means of transmitting torque comprise a ring centered on the longitudinal axis and comprising first pins cooperating with recesses formed in the screwed member and second pins cooperating with recesses formed in the rotor disc.

4. The assembly according to claim 2, wherein the second means of transmitting torque comprise a ring centered on the longitudinal axis and comprising first pins cooperating with recesses formed in the screwed member and second pins cooperating with recesses formed in the rotor disc, and wherein a circumferential clearance between the first splines and the second splines is less than the sum of a circumferential clearance between the second pins and the rotor disc and a circumferential clearance between the first pins and the screwed member.

5. The assembly according to claim 3, wherein the ring comprises an annular section, the first pins extending upstream and the second pins being arranged downstream from the first pins, at least one of the first pins and the second pins comprises concave rounded portions for connection to the annular section.

6. The assembly according to claim 3, wherein the second pins extend in the direction of the longitudinal axis, or extend in a radial direction perpendicular to the longitudinal axis.

7. The assembly according to claim 3, wherein the number of second pins is less than the number of first pins.

8. The assembly according to claim 3, wherein the ring is mounted around the screwed member.

9. A turbine extending around the longitudinal axis, comprising a stator and a rotor rotatably mounted in the stator, wherein the rotor comprises the assembly according to claim 3, wherein the ring is locked in downstream translation by a circlip installed in a groove in the screwed member.

10. The turbine according to claim 9, wherein an annular space is arranged immediately downstream from the screwed member, wherein said annular space has a longitudinal dimension greater than or equal to a longitudinal distance between moving vanes connected to the rotor disc and stator vanes located immediately downstream from the moving vanes.

11. A turbine engine, comprising the assembly according to claim 1.

12. A turbine engine, comprising the turbine according to claim 9.

* * * * *